United States Patent [19]

Fekete et al.

[11] 3,957,484

[45] May 18, 1976

[54] FLUID BED ROASTING OF METAL SULPHIDES AT HIGH TEMPERATURES

[76] Inventors: Simon Otto Fekete, 7277 W. 83rd Way, Arvada, Colo. 80003; Colin Bruce MacKenzie, 8 MacDonnell St., Falconbridge, Ontario, Canada; Philip George Thornhill, 210 Arnold Ave., Thornhill, Ontario, Canada; Edward Howard Coulter, 11 Jeremy Drive, Unionville, Ontario, Canada, L3R 2K7; Kenneth Leslie Agnew, 21 Hodge St., Apt. 4, Falconbridge, Ontario, Canada

[22] Filed: Sept. 18, 1974

[21] Appl. No.: 507,034

[30] Foreign Application Priority Data

Oct. 9, 1973 Canada ..... 182863

[52] U.S. Cl. ..... 75/9; 75/6; 75/26; 423/62

[51] Int. Cl.[2] ..... C22B 1/10

[58] Field of Search ..... 75/6, 9, 26; 423/62

[56] References Cited

UNITED STATES PATENTS

| | | | |
|---|---|---|---|
| 2,677,608 | 5/1954 | McKay | 75/6 |
| 2,796,340 | 6/1957 | Cyr | 75/9 |
| 2,813,015 | 11/1957 | Thornhill | 75/9 |
| 2,813,016 | 11/1957 | Thornhill | 75/9 |
| 2,819,157 | 1/1958 | Fischer | 75/9 |
| 2,930,687 | 3/1960 | Thornhill | 75/9 |
| 3,094,409 | 6/1963 | Renzoni | 75/9 |
| 3,661,558 | 5/1972 | Heath | 75/9 |

*Primary Examiner*—Peter D. Rosenberg
*Attorney, Agent, or Firm*—Richard J. Hicks

[57] ABSTRACT

An improved method for agglomerative fluid bed roasting of metal sulphide particles. The sulphide particles are fed as an aqueous slurry through the freeboard of the roaster onto the surface of a bed of roasted calcine agglomerate particles fluidized by a free oxygen-bearing gas. Slurry water is evaporated in the bed and the sulphides are roasted therein. The feed rates of sulphide, water and free oxygen-containing gas are controlled to ensure temperatures in the roaster such that fusion occurs during roasting and agglomerated calcine particles are formed with regular, rounded surfaces. Calcine particles small enough to become entrained in the roaster off-gases are readily disengaged therefrom in cyclones to provide substantially dust-free $SO_2$-bearing gas. A preferred practice of the method is feeding substantially the stoichiometric amount of free oxygen to convert the sulphide to $SO_2$ and metal oxide, thereby producing on the one hand a roasted oxide calcine substantially devoid of sulphur and on the other hand an $SO_2$-bearing gas substantially devoid of free oxygen. The method is particularly advantageous in the roasting of pyrrhotite concentrates and other sulphide concentrates containing pyrrhotite such as those derived from the nickel-copper ores of the Sudbury Basin.

13 Claims, 5 Drawing Figures

FLUID BED ROASTING OF METAL SULPHIDES AT HIGH TEMPERATURES

The invention relates in general to the roasting of metal sulphides, more specifically to fluid bed roasting of iron-bearing sulphides and particularly to agglomerative roasting of pyrrhotite-bearing concentrates at temperatures sufficient to cause fusion during roasting. It is well known that government restrictions which are now being placed on $SO_2$ emissions to the atmosphere require development of improved roasting processes such as the present invention to generate $SO_2$-bearing roaster gas that can more readily be treated for recovery of sulphur than is presently the case by existing processes. Thus, in the process of the present invention roaster gases are advantageously produced which are substantially devoid of gases such as $SO_3$ and free oxygen.

BACKGROUND OF THE INVENTION

While the patent literature on the roasting of metal sulphide concentrates is extensive, the bulk of the art relates to methods for roasting at temperatures insufficient to cause fusion and the resulting agglomeration of the particles. A select few patents relate to fluid bed roasting at temperatures sufficiently high to cause agglomeration, and even fewer teach the feeding of sulphides to fluid bed roasters as aqueous slurries rather than as discrete particles or particle agglomerates.

While the present invention is an improved method for agglomerative roasting and a detailed review of non-agglomerative roasting is therefore unnecessary, brief comment is in order to draw attention to the characteristic disadvantages of such roasting in general and the resulting incentives to develop successful means for agglomerative roasting. A reading of U.S. Pat. Nos. 2,556,215; 2,785,050; 2,943,929; 2,993,778; and 3,160,496 provides a reasonable indication of the breadth of methods for non-agglomerative roasting and their principal characterizing features. Thus it is seen that in general these patents teach fluid bed roasting at temperatures below 1000°C with dry sulphide feeds and the characteristically disadvantageous results of inefficient and incomplete roasting, high air factors, fine product, high recirculating loads and roaster gas heavily laden with dust, free oxygen and $SO_3$.

Such disadvantages should be at least partly overcome by roasting at higher temperature to take advantage of faster reaction rates and agglomeration of particles resulting from fusion of sulphides. The fact is, however, that existing methods for agglomerative fluid bed roasting of sulphides are fraught with their own difficulties and disadvantages, as indicated by a reading of U.S. Pat. Nos. 2,796,340; 2,819,157; 2,850,370 and 3,094,409. These methods teach feeding of metal sulphides to the bed as discrete particles or particle agglomerates and roasting at temperatures generally greater than about 1000°C. Roasting is either incomplete or achieved only by adoption of expedients such as oxygen-enriched air and high air factors, thereby leading to roaster off-gas containing excess free oxygen. Difficulty is also experienced in preventing defluidization resulting from excessive agglomerative growth of bed particles as indicated by the adoption of various other undesirable practices. In U.S. Pat. No. 2,850,370, for example, the temperature of the bed is cycled above and below the temperature of incipient sintering of particles, apparently in an attempt to control agglomerative growth of the bed particles. The need for such an expedient indicates inability to control agglomeration at the upper end of the temperature range thereby requiring the temperature to be lowered periodically to decrease or stop particle growth. The effect of the lower temperature is to decrease not only agglomeration, however, but also the rate and therefore the degree of extent of roasting, and also to increase the generation of fine particles that become entrained in the roaster off-gas, all undesirable side effects of this temperature cycling technique.

Prior to the development of the present invention our own attempts to effect agglomerative fluid bed roasting at temperatures high enough to cause fusion were similarly unsuccessful as the other such methods referred to above. Thus we found that when finely divided pyrrhotite particles were fed dry to a fluid bed of roasted calcine particles, there was incomplete sulphur elimination at bed temperatures below about 1000°C, while above this temperature there was uncontrolled, catastrophic growth of the calcine particles that eventually resulted in defluidization. Similar effects resulted from dry feeding of a chalcopyrite concentrate to a fluid bed roasting operation at somewhat lower temperatures around about 950°C.

Two patents relating to the feeding of sulphides to fluid bed roasters as aqueous slurries are relevant to the present discussion. One is U.S. Pat. No. 2,677,608 which teaches that in the conduct of exothermic processes in fluid beds, such as roasting of sulphides, the feed solids should be charged as an aqueous slurry through the sidewalls of the fluid bed reactor and into the fluid bed, not only to simplify the feeding of the solids themselves but also to provide water to the bed as a cooling medium, and specifically to prevent the temperature of the bed rising during the progress of the exothermic process to the point that fusion occurs, at which temperature defluidization has been the anticipated, and commonly the inevitable result.

The other patent is U.S. Pat. No. 2,813,015 which teaches feeding sulphides to a fluid bed roaster as an aqueous slurry through the freeboard together with compressed air to disperse the slurry into a spray of slurry droplets from which water evaporates during their descent through the freeboard to form first wet agglomerates and finally dry agglomerates which enter the bed where they are roasted. The desirability of evaporating slurry water in the freeboard and not in the bed is repeatedly emphasized as a cornerstone of the method. The sulphide agglomerates are held together by a binder, advantageously sodium sulphate for the preferred practice of the invention to sulphatize nickel selectively with respect to iron in sulphide concentrates. Such sulphation is conducted at temperatures at or below about 700°C and generates roaster gas that contains not only $SO_3$ and free oxygen but also much finely divided dust.

Apart from the disadvantages of the existing methods reviewed above, a major weakness that is common to all of them is the generation of roaster gas with undesirable constituents for subsequent treatment to recover sulphur, particularly by reduction of $SO_2$ in the gas to elemental sulphur. Thus in general, the gases contain either or both free oxygen, which will consume fuel in the reduction process, and dust that is difficult to disengage even in electrostatic precipitators never mind in cyclones. In addition, those gases produced by the lower temperature methods also contain $SO_3$.

In summary then, there are no existing methods, of which we are aware, by which metal sulphides can be agglomeratively roasted in a fluid bed to produce advantageously not only a substantially dead-roasted, sulphur-free calcine on the one hand, but also a roaster gas on the other hand from which entrained solid particles can be readily and substantially completely removed and which furthermore is substantially devoid not only of $SO_3$ but also of free oxygen so that the gas can be readily treated for recovery of sulphur, particularly by reduction of $SO_2$ in the gas to elemental sulphur. Such are the achievements of the present invention.

One particular advantage of the present method as applied specifically to nickeliferous pyrrhotite concentrates is the production of a calcine which, contrary to the teachings of the prior art, is readily treated for recovery of nickel therefrom by either of two existing methods — the one comprising gaseous reduction of the nickel in the calcine followed by leaching thereof in ammoniacal solutions, and the other comprising sulphatization of the nickel in the calcine followed by leaching thereof in water.

Thus in reading Canadian Pat. Nos. 530,842; 593,622 and 607,302, one finds repeated statements to the effect that calcines resulting from the roasting of nickeliferous pyrrhotite concentrates are not responsive either to the reduction-ammonia leach method, if the roasting is done at temperatures in excess of about 1600°F, i.e. about 870°C, or to the sulphating-water leach method if the roasting temperature is in excess of about 1400°F, i.e. about 760°C. It is emphasized that the calcines should be unagglomerated and porous and that temperatures that would cause sintering, fusion, densification, and the like are to be specifically avoided, that is to say, for example, temperatures in excess of 1000°C or so at which temperatures agglomerative roasting of pyrrhotite occurs. Thus the calcines generated by the methods described in the patents referred to above are finely divided with particle sizes characteristically less than about 200 Tyler mesh, the operations are dusty, and because roasting is effected with air in considerable excess of that stoichiometrically required to convert the pyrrhotite to hematite and $SO_2$, the roaster off-gases contain significant concentrations of free oxygen as well as copious quantities of fine calcine dust particles. These and other disadvantages are overcome by the practice of the present invention and in addition, described and discussed in more detail below, calcine resulting from roasting nickeliferous pyrrhotite concentrates by this invention is readily responsive to both the methods for extraction of nickel referred to above.

SUMMARY

The essential elements of the present improved method for roasting particulate metal sulphide in a fluid bed reactor containing a bed of roasted calcine agglomerate particles fluidized by a free oxygen-containing gas and superposed by a freeboard, comprise feeding metal sulphide particles as an aqueous slurry onto the surface of the fluidized bed thereby supplying water as well as sulphide to the bed, evaporating slurry water in the bed thereby forming agglomerates of slurry sulphide particles that become dispersed in the bed as evaporation occurs, roasting the sulphide and controlling the rates of feeding sulphide, water and free oxygen-containing gas to the bed to control temperatures in the bed and freeboard of the reactor such that fusion occurs during roasting thereby forming roasted calcine agglomerates of controlled size and regular, rounded shape, recovering calcine agglomerates from the bed and recovering sulphur dioxide-containing gas from the freeboard with entrained dust particles in an improved form for disengagement from the gas prior to sulphur recovery therefrom. Thus the basic utility of the invention is to produce a roaster gas in advantageous condition for subsequent treatment to recover sulphur therefrom, an object that has apparently not even been considered in the past much less provided for by existing methods. Major advantages of the invention in its preferred application for complete or dead roasting of the sulphide are firstly that substantially complete roasting is not only effected in practice, thereby producing calcine substantially devoid of sulphur on the one hand, but secondly that this dead roast is effected with quantities of free oxygen so close to the stoichiometrically required amount to convert the sulphides to metal oxide and $SO_2$, that the resulting roaster gas is substantially devoid of free oxygen on the other hand.

Thus it is the basic object of the present invention to provide a process for fluid bed roasting of metal sulphide to produce gas in an improved condition for subsequent treatment to recover sulphur.

In addition it is a preferred object of the invention to provide an improved process for dead roasting metal sulphide to produce metal oxide calcine substantially devoid of sulphur.

Furthermore, it is an object of the invention to provide an improved process for the fluid bed roasting of metal sulphides to produce calcines which, contrary to the teachings of the prior art, respond readily and well to leaching in both sulphate and ammoniacal systems.

Other objects, results and advantages of the invention are identified in the more detailed description and discussion below.

DESCRIPTION OF THE PREFERRED EMBODIMENT

Figure 1:
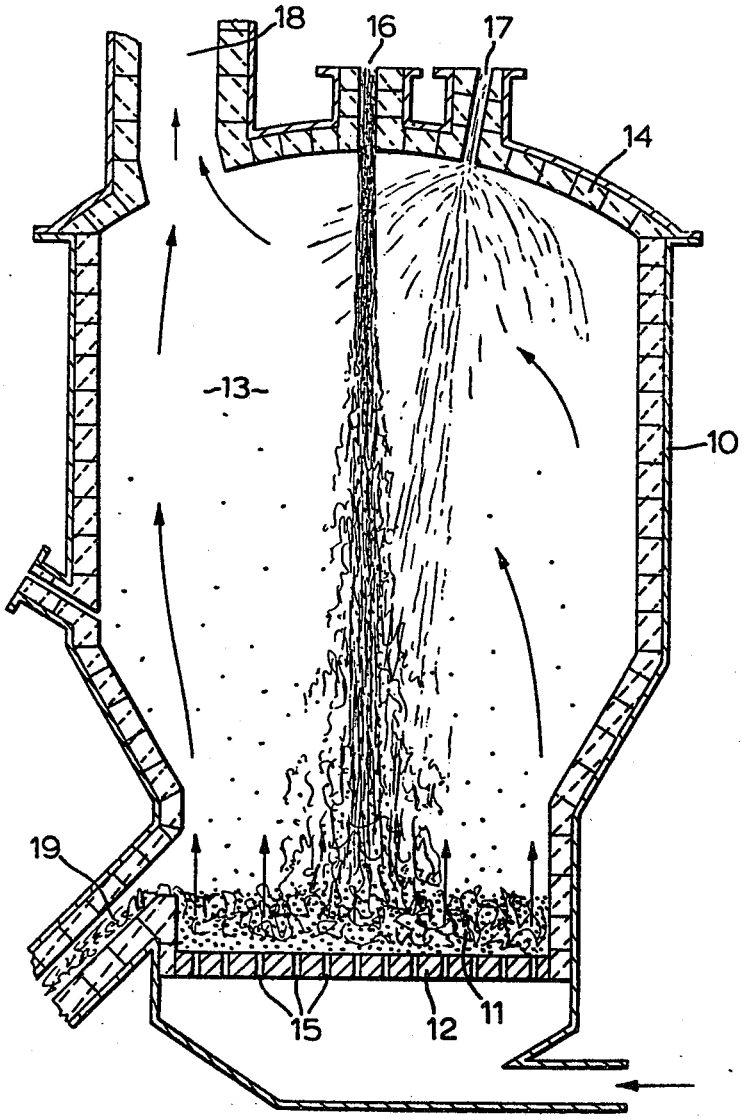
FIG. 1 is a schematic sectional view in elevation through a fluid bed roaster and illustrates those features of the invention that can be graphically represented.
Figure 2A:
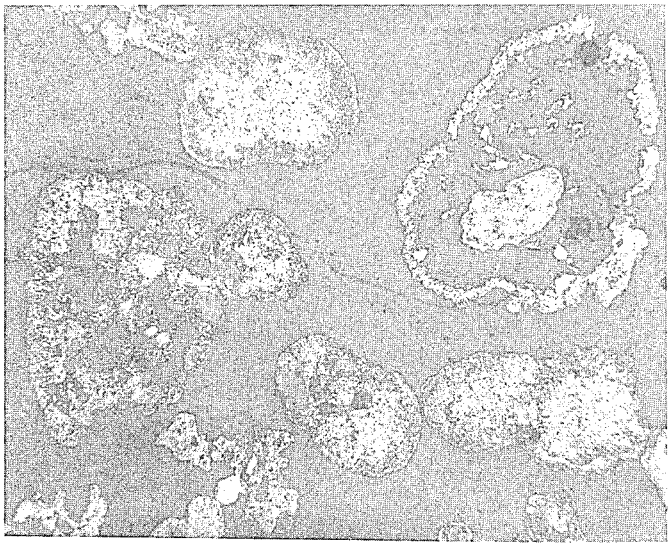
FIG. 2 is a series of photomicrographs of various size fractions of calcine agglomerate particles made by the practice of the present invention.
Figure 2B:
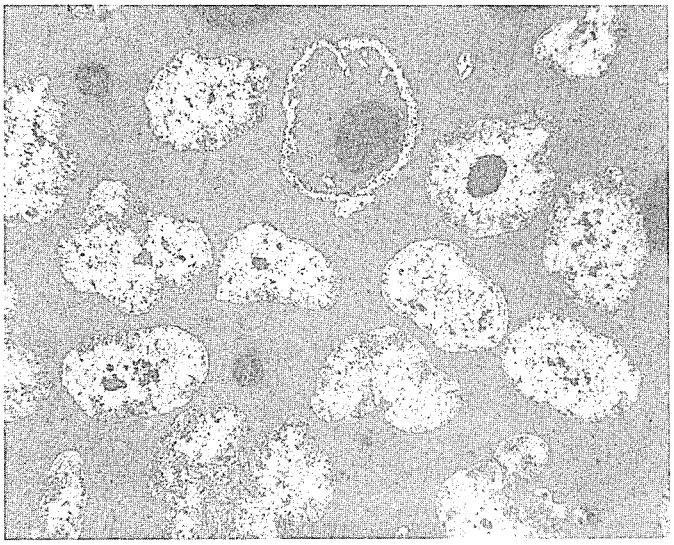
Figure 2C:
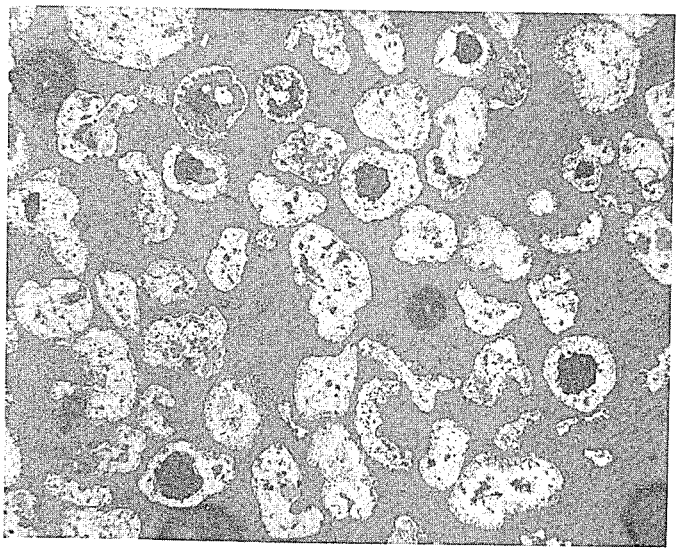
Figure 2D:
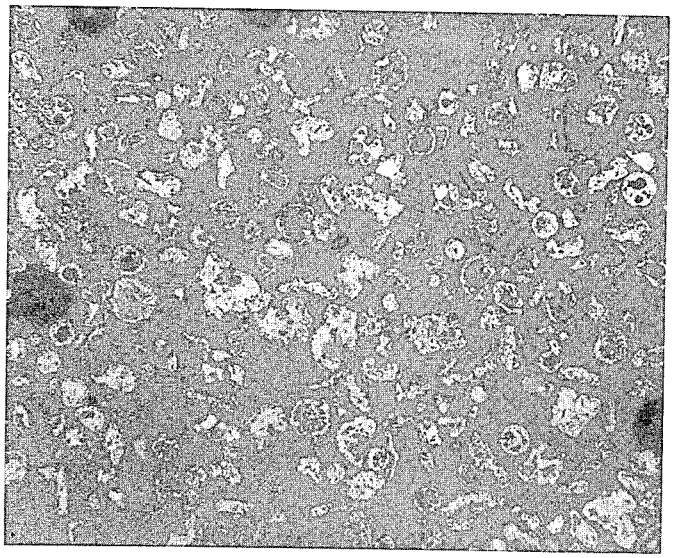

Referring first to FIG. 1, a fluid bed roaster in which the method can be carried out is described. Basically the roaster consists of a refractory line steel shell 10, enclosing a lower fluid bed section 11, resting on a hearth 12, and superposed by an upper expanded freeboard section 13, closed by a roof 14. A multiplicity of nozzles 15, are set in the hearth through which a free oxygen-bearing gas, conveniently and advantageously air, is supplied to the roaster for fluidization of the bed and roasting of the sulphide feed. A feed pipe 16, is set vertically in the centre of the roof through which metal sulphide particles are fed into the roaster as an aqueous slurry. Also in the roof is another pipe 17, through which water can be supplied to the roaster in addition to that in the feed slurry. A refractory-lined duct 18, is also provided in the roof for withdrawal of roaster gas to cyclones and other gas handling and treatment equipment not shown in the drawing. Near the upper end of the fluid bed section of the roaster is another refractory lined duct 19, through which roasted calcine overflows from the fluid bed. Other openings through the shell are advantageously disposed to accommodate thermocouples, sampling devices, viewing windows and the like.

Roasting according to the present invention is advantageously effected under substantially steady state conditions; that is to say there are no programmed fluctuations such as the purposeful and regulated cycling of bed temperature that is a feature of one of the prior art process referred to above. The operating conditions, such as flow rates of gas and feed slurry, can of course be varied but are nominally constant and are adjusted and controlled in response to changes in other conditions, such as slurry density, bed temperature and calcine agglomerate size, to maintain desired results of the roasting operation, such as sulphur content of the calcine, and free oxygen content of the gas.

While the invention can be applied to the roasting of metal sulphide concentrates in general, it is particularly applicable to concentrates containing iron sulphides, such as, for example, the nickel-copper sulphide concentrates and the nickeliferous pyrrhotite concentrates derived from the sulphide ores of the Sudbury Basin.

Concentrates derived from the milling of ores usually contain a significant proportion of −200 Tyler mesh particles and the nickeliferous pyrrhotite concentrate referred to above contains in addition a large proportion of −325 Tyler mesh particles, although this feature is not a necessary limitation of the invention. It is necessary only that the sulphide particles be small enough to be handled as an aqueous slurry for feeding to the roaster and to fuse, at least at their surfaces, at some stage during their treatment in the roaster.

The pulp density or percent solids of the sulphide concentrate roaster feed slurry is limited to the maximum at which the slurry can be pumped or otherwise handled and to the minimum at which the resulting temperature in the fluid bed is sufficient to cause fusion. The maximum pulp density is a function of the properties of the concentrate itself, notably its specific gravity and particle size distribution, while the minimum is a function of those factors affecting the heat balance in the roaster, principally the exothermic heat of sulphide roasting and the endothermic heat of water evaporation. Additional heat can be provided, if necessary, by preheating the air or other free oxygen-bearing gas used for fluidization and roasting, while excess heat can be consumed by increasing the flow of water to the roaster, conveniently by a separate addition of cooling water independent of the water in the feed slurry. By the latter means pulp density can be maintained at least nominally constant while the flow of cooling water is adjusted and controlled as necessary to trim temperatures in the roaster, notably the bed temperature. For the nickeliferous pyrrhotite concentrate mentioned above maximum pulp density is about 75% solids and the usual operating pulp density is within the range of about 71–73% solids.

The sulphide slurry is fed into and falls through the freeboard of the roaster onto the bed. While the slurry could be fed through several feed pipes disposed in the roof of the roaster, a notable advantage of the present invention is that even in large roasters many feet in diameter, only one feed pipe is necessary, preferably, although not essentially, in the centre of the roof. With centre feeding, the sulphides are most readily kept away from the walls of the roaster thereby avoiding build-up of accretions thereon which might otherwise occur as in existing processes, notably those based on feeding sulphides through the sidewall of the roaster below the surface of the bed.

The slurry can be fed with or without compressed air injected into the slurry feed pipe, as described in U.S. Pat. No. 2,930,687 and applied in the process of U.S. Pat. No. 2,813,015 to disperse the slurry in the freeboard into a spray of slurry droplets. The difference in the present case is that the bed and not the freeboard is the principal location for evaporation of slurry water and thus the amount of air injected, if any, is provided to adjust freeboard temperatures by effecting somewhat more fragmentation of the slurry stream and consequent evaporation of water in the freeboard than occurs otherwise solely under the influence of the turbulently rising roaster gases.

The slurry falls into the bed, which consists primarily of roasted calcine agglomerate particles, a major proportion of which are characteristically greater in size than about 65 Tyler mesh, and is fluidized by a free oxygen-bearing gas, conveniently although not necessarily air. The gas could be oxygen-enriched air or other free oxygen-bearing gas and could be at ambient temperature or preheated depending on the thermal requirements in a given situation. Unheated air is most convenient and therefore preferred, and is suitable for pyrrhotite concentrates and other sulphide concentrates containing pyrrhotite.

The flow of gas is dependent on the requirements for fluidization of the bed, and the flow of sulphides and water in the feed slurry is fixed with respect to the gas flow such that the temperature in the fluid bed is sufficient to cause fusion during roasting as indicated by the relatively regular, rounded shape of the roasted calcine particles, shown in FIG. 2, which is notably different from the characteristically angular appearance of the original sulphide concentrate particles. Within this limitation the temperature is then adjusted to control the particle size of the agglomerates, higher temperatures resulting in a larger average agglomerate size. The bed temperatures necessary for pyrrhotite-bearing concentrates are generally in about the 1000°–1100°C range and for nickeliferous pyrrhotite concentrates are preferably about 1030°–1080°C.

The bed temperature is dependent primarily on the net effect of the endothermic evaporation of water and the exothermic roasting of sulphides and is therefore affected by changes in the relative flows of water and sulphides to the bed and the rates and extents of evaporation and roasting. Since it is not only convenient from an operating standpoint, however, but also preferable from a performance standpoint, to maintain at least the major operating parameters as constant as possible, the present invention is preferably practised at nominally constant gas flow, feed slurry pulp density and slurry flow to the roaster. The resulting temperatures in the roaster are therefore nominally constant as well, but deviations that result from minor changes in these conditions, or others that could affect the rate or extent of roasting or the heat generated thereby, such as the chemical composition of the sulphide concentrate or its particle size distribution, for example, can be compensated for by feeding water to the roaster independently of and in addition to the water in the feed slurry, and adjusting the flow of this auxiliary cooling water in accordance with the temperature in the roaster.

Cooling water introduced through the freeboard of the roaster is obviously evaporated to some extent in the freeboard but the proportion of the cooling water so evaporated depends on the size of the water droplets in the freeboard. If cooling water is fed to the freeboard as a coherent stream, a smaller proportion is evaporated therein than if the water is fed as a fine spray. Thus the proportion of freeboard evaporation is under control depending on how the cooling water is fed and in the present application it is generally fed so that the majority of it, like that of the slurry water, is evaporated in the bed. The reasons for this are that cooling water is fed primarily for control of the bed temperature in the first place, and in the second place that the freeboard should be hot enough itself to cause fusion of sulphide-bearing particles suspended therein that might not have fused in the bed or might never have been in the bed. Thus freeboard temperatures in the practice of this invention are in general less than 100°C lower than bed temperatures and are usually only about 50°C lower, although these figures are mentioned by way of illustration only and not as a specific limitation of the invention. The point is that while the majority of evaporation and roasting occurs in the bed, provision is made to ensure that sulphides in small droplets of slurry that might break away from the slurry stream as it passes through the freeboard and never reach the bed are roasted in the freeboard to produce calcine particles similar in appearance and behaviour to those generated in the bed.

Gas is withdrawn from the roaster above the bed, preferably from the top of the freeboard, and this gas contains the smaller calcine agglomerates as entrained dust particles, which, it has been discovered, are disengaged from the gas almost completely in cyclones alone, without the use of other dust collecting devices such as electrostatic precipitators. It has also been found that even the few, minute particles that do remain in the post-cyclone gas do not foul the surfaces of heat exchange ducts over which the gas is passed prior to its subsequent treatment for recovery of sulphur therefrom.

According to the practice of the present invention, as generally and broadly described above, we have found that agglomerative roasting of metal sulphides at fusion temperatures is effected with a degree of operating stability and control of calcine agglomerate particle size heretofore unknown. Roasting can be effected on a continuous basis indefinitely under nominally constant operating conditions and agglomeration controlled at will to produce calcine of given characteristic particle size.

In a more specific application of the invention we are able not only to maintain a stable operation and the production of a readily cleanable roaster gas, but also to effect a substantially complete or dead roast while at the same time generating roaster gas with a negligible free oxygen content. As mentioned earlier this is a particular advantage in the subsequent treatment of the gas to recover sulphur by reduction of the contained $SO_2$ to elemental form.

To effect such a dead roast the flows of fluidizing gas and sulphide to the roaster are controlled so that the free oxygen supplied is substantially only stoichiometrically sufficient to roast the sulphides completely to $SO_2$ and metal oxide, and the operation is otherwise conducted in the manner described above. Roasting of pyrrhotite-bearing concentrates under these conditions results in iron oxide-bearing calcine with characteristically less than 0.2 wt. % contained sulphur when the free oxygen supplied is in excess of but so close to the stoichiometric requirement that the corresponding roaster gas generally contains less than 1 vol. % free oxygen on a dry basis. Such results reflect a degree of efficiency in the utilization of free oxygen that is quite unrealized by existing methods.

Such iron oxide calcines generally consist primarily of hematite but may also contain magnetic as well, and the magnetite concentration, like the sulphur content of the calcine, is an inverse function of the free oxygen content of the roaster gas. Thus when the invention is practised with a stoichiometric deficiency of free oxygen for complete roasting, the calcine may consist primarily of magnetite, without significantly affecting other distinguishing features of the invention, notably the stability and controllability of the operation and the ready separability of entrained calcine particles from the roaster gas.

Having described the practice of the invention in its general and preferred embodiments, it is of interest to speculate on the reasons for its success in view of the teachings of the existing art. Thus, contrary to the teaching of U.S. Pat. No. 2,677,608 that water in metal sulphide feed slurry should be evaporated in the bed specifically to prevent fusion conditions in the bed that would otherwise prevail, it appears to be the very presence of such slurry water in our bed that permits us to operate under such fusion conditions and achieve improved continuity of operation, control of agglomeration, separability of entrained solids from roaster gas and efficiency of oxygen utilization for roasting compared to existing methods practised under effectively similar fusion conditions but without slurry feeding.

It is suggested the basic reason for the remarkable success of the invention is a delay in the onset of roasting of sulphides after entering the bed that is occasioned by evaporation therein of the slurry water associated with the sulphides, thereby providing time for the sulphides to become dispersed from their point of entry into the bed before roasting commences. Ignition of the sulphides is thereby delayed until sufficient dispersion throughout the bed has occurred to prevent growth of oversized agglomerates. Thus agglomerative roasting is effected under fusion conditions but with such control of resulting calcine particle size that the operation can be continued indefinitely without defluidization that would predictably result from otherwise uncontrolled or uncontrollable growth and accumulation of intolerably large particles.

The reasonableness of this suggestion will be appreciated upon consideration of the corresponding effect of fusion conditions in the bed without slurry feeding, as in the high temperature prior art methods reviewed earlier. Under such circumstances the sulphides presumably become heated to roasting temperature faster upon entering the bed than with slurry feeding, and therefore begin to roast and become fused in closer proximity to one another with greater resulting likelihood of catastrophic growth of calcine agglomerate particle size and consequent defluidization, a hazard that is therefore clearly identified with the prior art.

Just what the mechanism of agglomerative roasting is in the present case we do not know for certain but the following interpretation is suggested as not only reasonable but consistent with the known facts regarding operating conditions and results. Thus it is visualized that when the slurry enters the bed it is fragmented under the fluid action of the bed into globules or droplets of slurry that move away from the point of entry and thereby become distributed in the bed as evaporation of the slurry water in the globules occurs. Some of these globules may become further fragmented to individual sulphide particles, and indeed such fine dispersion may occur to some extent at the outset, but in any case it is suggested that a large if not the major proportion of the sulphides are associated with others and with water in slurry droplets and that the sulphide particles in such droplets remain associated with one another as sulphide agglomerates after evaporation of the slurry water therefrom. Following evaporation of water from droplets the resulting sulphide agglomerates become rapidly heated to roasting temperature and commence to roast and subsequently to fuse, at least on their surfaces. By this time they are isolated from one another in the bed, however, and are therefore roasted as independent entities without the occurence of intolerable sticking to one another or to other particles in the bed. The surfaces are only transiently in the molten state because as roasting proceeds the effective fusion point of the oxide-sulphide mixture ultimately rises above the temperature of the bed and the agglomerate surfaces then solidify. Thereafter roasting of the inner material can continue even under fusion conditions without the agglomerates being subject to further growth except perhaps, by contact with other material which at the time is itself molten. Such growth probably does occur to some extent, but regardless what agglomerating and growth mechanisms apply they obviously do not occur to excessive or intolerable extents. The resulting calcine agglomerate particles with the regular, rounded surfaces illustrated in FIG. 2 and indicative of fusion at some stage in their treatment, are not only readily fluidized but their nominal or characteristic size or size range is readily controlled by adjustment of operating conditions, notably bed temperature, by means earlier described. Generally speaking the hotter the bed the larger the average calcine particle size, presumably because the surface of each agglomerate is molten for longer during roasting and consequently more growth occurs.

In addition to control of calcine particle size, the suggested delay in roasting during evaporation of slurry water in the bed is consistent with, if not also responsible, at least in part, for the remarkably efficient utilization of free oxygen in the roasting gas, a fact that is another notable feature and advantage of this invention. Thus it has been found when feeding slurry onto the centre of the bed surface, fluidizing with air, and producing roaster gas with say about 1 vol. % free $O_2$, dry basis, the corresponding oxygen content of the gas near the sidewall immediately above the bed is in general say about 2 vol. %, thereby indicating approximate consumptions of 5% of the total $O_2$ through the freeboard but 90% of the $O_2$ through the bed near the sidewall, and therefore about as far as possible from where the slurry enters the bed.

Turning attention now to the freeboard, it is noted that while characteristically about 95% or so of the roasting appears to occur in the bed, the oxygen gradient through the freeboard does indicate some roasting therein. Sulphides that are roasted in the freeboard could emanate from either or both of two sources, the bed and the feed slurry. Thus it is expected that some sulphide agglomerates formed in the bed are partially roasted in the freeboard when they are ejected from the bed into the freeboard on occasion by the upward forces in the bed. The larger of such particles probably spend little time in the freeboard, are largely roasted in the bed and report as bed calcine, whereas the smaller ones could conceivably remain in the freeboard once they have been ejected from the bed, and report as entrained dust in the roaster off-gas. It is also visualized that some formation of slurry droplets occurs in the freeboard under the fragmenting influence of the turbulently rising roaster gases on the surface of the slurry stream as it falls through the freeboard. The larger of such droplets might fall into the bed and report ultimately as bed calcine, while the smaller ones might never reach the bed at all but remain in the freeboard and report ultimately in the off-gas. In the latter case all evaporation of water from the slurry droplet and roasting of the resulting sulphide agglomerate would occur in the freeboard and such roasting could well represent a large, if not the major portion of the roasting that does take place in the freeboard.

In any case, the significant point is that temperatures in the freeboard are such that fusion of particles that are roasted therein does occur and the resulting calcine particles therefore have similar shape and other properties as those roasted largely if not completely in the bed. Thus regardless whether the dust particles in the roaster off-gas were ever in the bed or not, they are readily disengaged therefrom in cyclones to produce post-cyclone gas substantially devoid of solids, that is to say with characteristically about 3 grains or less per standard cubic foot of gas. As mentioned earlier, the freeboard temperatures characteristic of the present invention are nearly as high as the bed temperature, within usually about 50°C, because the bulk of the water fed to the roaster is evaporated in the bed, not the freeboard.

Thus it is seen that all the advantages of the invention — in general a sustained, controlled agglomerative roasting operation under substantially steady-state conditions with production of roaster off-gas from which entrained solids can be readily disengaged in preparation of the gas for subsequent treatment to recover sulphur therefrom, and in a preferred embodiment of the invention the production of both dead-roasted calcine on the one hand and roaster off-gas with negligible free oxygen on the other hand — all of these advantages flow from the two essential features of the method that together distinguish it from existing methods, that is feeding the sulphides as an aqueous slurry onto the bed and maintaining temperatures in the roaster under which fusion occurs during roasting. The evaporation of water in the bed that results from feeding the slurry onto the bed permits dispersion of sulphides in the bed before roasting, which in turn results in more efficient use of oxygen for roasting and permits fusion temperatures without catastrophic growth of calcine agglomerates, and both of these conditions lead to a sustained, controlled operation and substantially complete and efficient roasting. At the same time freeboard temperatures are also high enough to ensure fusion of the agglomerates formed in the freeboard that never reach the bed, which in turn ensures that dust particles, regardless whether they were roasted in the bed or the freeboard are readily disengaged from the off-gas in cyclones.

FIG. 2 emphasizes the similarity in appearance of the calcine agglomerate particles regardless of their size. The term agglomerate is used simply to indicate that a calcine particle consists of a multiplicity of original feed particles, albeit in altered form. The bulk of the calcine particles are larger than 65 Tyler mesh although most of those which become entrained in the roaster off-gas are smaller than 150 Tyler mesh. The rounded shape and relatively dense appearance is common to agglomerates of all sizes, however, and is indicative of fusion at some stage in the roasting process and at least at the surfaces of the agglomerates. It is suspected that some of the particles are more hollow than they appear simply because the surfaces exposed in the polished sections are within the relatively solid shells of the agglomerates but in any case they behave similarly as indicated by the substantially complete disengagement of entrained dust particles from the roaster off-gas when passed through cyclones.

The present invention and its advantages have been described and discussed with respect not only to the roasting operation itself but also to the subsequent treatment of the roaster off-gas to recover sulphur therefrom. Equally important are the substantial and unanticipated advantages of the invention with respect to subsequent treatment of the calcine to recover metal values therefrom. Thus as mentioned earlier, the application of this invention to the roasting of nickeliferous pyrrhotite concentrates results in the production of calcine which, contrary to the teachings of the prior art, is readily responsive to subsequent treatment for recovery of nickel by at least two known methods involving leaching. In the relevant prior art patents referred to eariler, data are presented which show that roasting done at temperatures above the recommended ranges results in calcine from which subsequent nickel recoveries are less than those from calcines produced at temperatures below the quoted upper limits. Even the highest roasting temperatures quoted in these prior art patents are considerably below those characteristic of the present invention, however, and are in fact below those at which fusion occurs during roasting. Thus the high nickel recoveries from the calcines of the present invention are not only unanticipated by the prior art but are also presumably due to the fact they were formed at temperatures sufficiently high to cause fusion at some stage during roasting. The reason for the surprisingly good nickel extractions from these calcines is not certain although it is reasonable to expect that the phases present in calcines generated at fusion temperatures would differ from those formed in the solid state. Thus it might be, for example, that the poor nickel extractions from the calcines made in the solid state by the prior art methods imply the presence of nickel ferrites that do not respond well to the extraction treatment, while at the higher temperatures of the present invention such ferrites are presumably either destroyed or not formed in the first place, and replaced by phases that are more characteristic of fusion or smelting conditions and more responsive to the extraction process. Whatever the reason the fact remains that nickel extraction from calcine made by the practice of the present roasting method is unexpectedly high and this is one of the many attractions of the invention, the nature and advantages of which are further illustrated by reference to the following specific examples.

EXAMPLE 1

This example demonstrates a preferred practice of the invention on a pilot plant scale for the dead-roasting of a nickeliferous pyrrhotite concentrate in air. The pilot roaster was 33 ft. high from the hearth to the roof with a fluidized bed section 7 ft. in diameter and an expanded freeboard section about 9.5 ft. in diameter. A single slurry feed pipe was disposed vertically in the centre of the roaster roof and a separate inlet in the roof was provided for the supply of cooling water to the roaster for fine temperature control. Nozzles were distributed uniformly in the hearth for the supply of air to fluidize the bed and provide free oxygen for roasting. An overflow duct was provided in the sidewall of the fluidized bed section for withdrawal of calcine from the bed and a duct at the top of the freeboard was provided for withdrawal of roaster off-gas with entrained calcine dust particles to cyclones.

The nickeliferous pyrrhotite concentrate had the following chemical composition in wt.%.

| Ni | Fe | Cu | S | $SiO_2$ | Insol. |
|---|---|---|---|---|---|
| 1.— | 56.— | 0.08 | 37.— | 1.5 | 4.4 |

The particle size of the concentrate was about 80% −325 Tyler mesh. An aqueous slurry of this concentrate containing about 71% by weight of solids was fed to the roaster at a rate of about 46 lb./min. together with a small flow of compressed air, about 2.5 scfm, to effect some dispersion of the slurry stream in the freeboard. Air was blown through the nozzles at a rate of 1660 scfm, equivalent to a nominal air factor of about 1.03, i.e. just slightly in excess of that required stoichiometrically to convert the pyrrhotite to hematite and $SO_2$. The bed, which consisted largely of roasted calcine particles, was fluidized at a free space velocity at operating temperature of about 3.3 ft./sec. and had a fluidized depth of about 5 to 6 feet. The bed temperature was about 1055°C and was maintained at this level by controlling the feed rate of cooling water between about 0.1 and 0.8 igpm in response to temperature fluctuations. The temperature in the freeboard was about 1000°C and at the off-gas duct was about 925°C.

The bulk of the roasted calcine was recovered from the bed through the overflow duct with the following chemical analysis in wt. %:

| Ni | Fe | Cu | S | $SiO_2$ | Insol. |
|---|---|---|---|---|---|
| 1.2 | 66.— | 0.08 | 0.08 | 1.2 | 1.5 |

The particle size of this bed calcine agglomerate particles was about 80% + 65 Tyler mesh. The remainder of the calcine, amounting to about 16% of the total, was entrained in the roaster off-gas and the chemical analysis of this dust as recovered from a cyclone downstream from the roaster was, in wt. %:

| Ni | Fe | Cu | S | $SiO_2$ | Insol. |
|---|---|---|---|---|---|
| 1.— | 62.— | 0.1 | 0.2 | 5.— | 4.5 |

This cyclone dust had a particle size of about 75% −200 Tyler mesh but constituted substantially all of the solids entrained in the roaster off-gas. The residual dust loading in the post-cyclone gas was only 2–3 gr/scf. The free oxygen concentration of the gas was less than 0.5 vol. %, dry basis, the $SO_2$ concentration was about 13 vol. %, and the $SO_3$ content was negligible.

Thus according to the preferred practice of the invention, the relatively finely divided pyrrhotite particles in the feed slurry were converted into relatively coarse, readily handleable agglomerates of oxide calcine substantially devoid of sulphur, and at the same time roaster gas was generated that was substantially devoid of $SO_3$ and free oxygen, and in which entrained solids were readily disengaged in cyclones to provide a cleaned high-grade, $SO_2$— bearing gas for subsequent treatment to recover sulphur.

EXAMPLE 2

During many months of operation of the pilot plant roaster with nickelferous pyrrhotite feed similar to that referred to in Example 1, experience indicated that roaster performance was sensitive to the sulphur concentration of the feed, which varied in the range of about 32–37%. At lower concentrations bed temperature had to be higher to maintain consistency in the degree of agglomeration and other performance parameters, as indicated in Table 1. It is seen from the table that roaster performance was characterized by substantially complete desulphurization of the feed to less than 0.1% S in bed calcine, agglomeration to about 80% +65 Tyler mesh, a cyclone dust made of about 20% of the total calcine, and a residual dust concentration in the roaster gas leaving the cyclone of less than about 3 gr/scf.

Table 1

Effect of Sulphur Content of Feed on Roaster Operation and Performance

| Mean & Range | S in Feed, wt.% | Air Factor Nominal | Temp, of Bed, °C | Bed Calcine +65 Mesh wt.% | Bed Calcine S, wt.% | Cyclone Dust, % Total Calcine | Dust in Clean Gas, gr/scf |
|---|---|---|---|---|---|---|---|
| Mean | 37.— | 1.05 | 1055 | 80 | 0.09 | 18 | 2.5 |
| Range | 36.7–37.2 | 1.03–1.08 | 1050–1060 | 77–82 | 0.08–0.09 | 16–22 | — |
| Mean | 35.— | 1.05 | 1060 | 75 | 0.10 | 17 | 2.2 |
| Range | 34.7–36.4 | 1.01–1.12 | 1053–1067 | 62–84 | — | 16–17 | — |
| Mean | 32.7 | 1.09 | 1065 | 80 | 0.08 | 22 | 2.9 |
| Range | 31.7–33.7 | 1.06–1.13 | 1053–1077 | 65–89 | 0.06–0.08 | 16–26 | 2.5–3.3 |

This performance was consistently achieved at nominal air factors less than 1.1 by adjusting the bed temperature between about 1050°–1080°C inversely with variations in the sulphur concentration of the feed between about 32–37%. Measured concentrations of free oxygen in the roaster gas were usually about 0.4–0.5% and generally less than 1 vol. % dry basis.

EXAMPLE 3

It was also discovered in operating the pilot roaster with nickeliferous pyrrhotite feed that bed temperature had to be varied with changes in air factor to maintain consistent roaster performance. This phenomenon was noted particularly with changes in nominal air factor around 1, under which conditions variations in the magnetite concentration of the calcine were significant. Thus it was found in one case, for example, that an air factor such that free oxygen in the roaster gas was only 0.1%, the calcine was 40–60% $Fe_3O_4$ and bed calcine particle size was controlled at about 90% +65 Tyler mesh at a bed temperature of about 1065°C, while with a similar feed at a higher air factor equivalent to 0.4% free oxygen in the roaster gas, the calcine contained only 3% Fe304 and to maintain a bed calcine particle size even as high as 70% +65 Tyler mesh, bed temperature had to be maintained at about 1100°C.

EXAMPLE 4

The pilot investigations also indicated that the roasting method could be practised over a range of free space velocities although, not surprisingly, the proportion of the coarser size fraction of the bed calcine increased with space velocity as indicated below:

| Free Space Velocity, ft/sec. | Bed Calcine, wt.% +65 Tyler Mesh |
|---|---|
| 2.7 | 55 |
| 3.3 | 65 |
| 3.6 | 85 |

EXAMPLES 5–7

In addition to the nickeliferous pyrrhotite concentrates referred to in the previous Examples, the preferred practice of the invention was also applied in the pilot roaster to the roasting of nickel-copper sulphide concentrates containing various proportions of pentlandite, chalcopyrite, pyrrhotite and pyrite. Significant operating and performance data characterizing ten-day operation periods for the treatment of each of these concentrates are summarized in Table 2.

Table 2

Roaster Operating and Performance Data for Nickel-Copper Concentrates

| Characteristics | Example 5 | Example 6 | Example 7 |
|---|---|---|---|
| Feed analysis, wt.% Ni | 6.5 | 8.5 | 9.7 |
| Cu | 2.8 | 6.5 | 8.— |
| Fe | 47.5 | 39.5 | 38.5 |
| S | 37.0 | 35.0 | 35.7 |
| Insol. | 2.6 | 5.2 | 4.5 |
| Feed particle size, %-325 mesh | 86.5 | 84.0 | — |
| Feed rate, dry lb./min. | 37.— | 46.5 | 46.8 |
| Feed slurry density, % solids | 72 | 73 | 73.5 |
| Air rate, scfm | 1270 | 1575 | 1600 |

Table 2-continued

| Roaster Operating and Performance Data for Nickel-Copper Concentrates | | | |
|---|---|---|---|
| Characteristics | Example 5 | Example 6 | Example 7 |
| Bed temperature, °C | 1015 | 990 | 990 |
| Free space velocity, ft,/sec. | 2.5 | 3.0 | 3.0 |
| Freeboard temperature, °C | 930 | 935 | 930 |
| Gas Outlet temperature, °C | 815 | 835 | 840 |
| Bed calcine analysis, wt.% Ni | 8.5 | 10.5 | 10.5 |
| Cu | 3.7 | 7.8 | 9.— |
| S | 0.2 | 0.45 | 0.45 |
| Insol. | 2.5 | 5.7 | 6.— |
| Bed calcine size,% +65 mesh | 90 | 96 | 95 |
| Cyclone calcine anal., wt.% Ni | 6.5 | 9.5 | 9.8 |
| Cu | 2.8 | 6.5 | 8.5 |
| S | 0.4 | 0.63 | 0.65 |
| Insol. | 6.5 | 7.9 | 6.8 |
| Cyclone calc. % of total calc. | 18 | 19 | 17 |
| Roaster gas, free $O_2$, dry vol.% | 0.4 | 1.2 | 1.2 |
| Post-cyclone dust conc. gr/scf | 6.5 | 5.5 | 5.7 |

Compared to the roasting of pyrrhotite, as described in previous Examples, it is seen from Table 2 that the roasting operation for the relatively low-iron, Ni-Cu concentrates is characterized by greater slurry density, lower roaster temperatures, more sulphur in the calcine and more oxygen and post-cyclone dust in the roaster gas. All of these differences from the treatment of pyrrhotite presumably result directly from the lower iron concentration of the Ni-Cu concentrate feed and its consequently lower calorific value. With less heat generated by roasting, the temperatures could be expected to be lower, as they were, in spite of somewhat higher slurry densities, and the lower temperatures were consistent both with the lower degree of roasting, as manifested by the higher sulphur calcine and the higher oxygen gas, and also with an apparently lower degree of agglomeration, at least of the finer particles, as indicated by the higher post-cyclone dust content of the gas. In spite of these differences the operation and results were preferred to those that could be anticipated for similar feed materials by existing methods.

EXAMPLE 8

The roasting of nickeliferous pyrrhotite according to the present method was extended to a larger scale than that of the previous examples. The larger roaster was 40 ft. high from the hearth to the top of the freeboard, with a fluid bed section 28 ft. in diameter, and an expanded freeboard section 37 ft. in diameter. The fluid bed again was 5–6 ft. deep and operation and performance were also similar to those of previous examples, except of course, for the absolute quantities and rates involved.

Thus typical operating and performance characteristics for this unit were as shown in Table 3.

Table 3

| Operating and Performance Characteristics for Nickeliferous Pyrrhotite in Large Roaster | |
|---|---|
| Characteristic | Example 5 |
| Feed analysis, wt.% Ni | 1.— |
| Cu | 0.05 |
| Fe | 57.5 |
| S | 33.5 |
| Insol. | 7.0 |
| Feed particle size,%-325 mesh | 80 |
| Feed rate, dry tons/hr. | 20.— |
| Feed slurry density, % solids | 72 |
| Air rate, scfm(60 F, 14.7 psia) | 23,000 |
| Bed temperature, °C | 1,065 |
| Free space velocity, ft/sec. | 3.— |
| Freeboard temperature, °C | 1,030 |
| Gas Outlet temperature, °C | 990 |
| Bed Calcine analysis, wt.%S | 0.15 |

Table 3-continued

| Operating and Performance Characteristics for Nickeliferous Pyrrhotite in Large Roaster | |
|---|---|
| Characteristic | Example 5 |
| Insol. | 5.— |
| Bed Calc. size, % +65 mesh | 65.— |
| Cyclone Calcine anal. wt.%S | 0.25 |
| Insol. | 9.— |
| Cycl. Calc.,% of total Calc. | 25 |
| Roaster gas, free $O_2$, dry vol. % | 0.9 |
| Post-cyclone dust conc., gr/scf | 2.5 |

In addition to the data tabulated above, another significant fact was that while compressed air could be supplied to the slurry feed pipe, slurry was usually fed to the roaster without any compressed air whatsoever. Under such conditions dispersion of the feed slurry stream as it fell through the freeboard was clearly restricted solely to that resulting from the fall of about 34 feet against the turbulent, uprising roaster gases. The remainder, and presumably most, of the dispersion occurred in the fluid bed, but in any case, wherever the dispersion occurred, the bulk of the evaporation apparently took place in the fluid bed, a feature that appears fundamental to the success and resulting advantages of the present invention.

EXAMPLE 9

To demonstrate the applicability of sulphate leaching to the extraction of nickel from calcine made by roasting nickeliferous pyrrhotite according to the preferred practice of this invention, a quantity of such calcine containing 1.15 wt. % Ni was first ground to about 90% −325 Tyler mesh. The ground calcine was then mixed with a 4 wt. % sodium sulphate, moistened and formed into prills. The prills were dried and 10 gm of dry prills were placed in a refractory boat and sulphated in a 1 inch diameter horizontal tube furnace at 680°C with $SO_2$ in air at a flow rate of about 500 ml/min. for 3 hours. The sulphated prills were then agitated in 250 ml of water at room temperature for 1 hour. The leached solids were filtered, washed, dried, weighed and found by analysis to contain 0.14 wt. % Ni, consistent with a nickel extraction of more than 88%.

EXAMPLE 10

Similar nickeliferous calcine to that referred to in Example 9, with a particle size of about 60% +65 Tyler mesh, was subjected to a reduction-ammonia leach treatment to determine the degree of nickel extraction by this technique. A 10 gm charge of the calcine was placed in a refractory boat and reduced in a 2 inch diameter horizontal tube furnace at 860°C in a gas with an $H_2/CO_2$ ratio of 0.5 for 1 hour. The reduced solids were then cooled under the same atmosphere and agitated in 150 ml of a solution containing about 80 g/l ammonia and about 110 g/l ammonium carbonate at 70°C under an overpressure of oxygen. Leaching was continued for 2 hours although measurement of oxygen consumption indicated that substantially all the leaching occurred in the first hour. The leached residue contained 0.13 wt. % Ni again indicating a Ni extraction of about 90%.

It is clear from the two examples above that the nickeliferous pyrrhotite calcine produced by this invention is quite amenable to treatment for recovery of nickel therefrom by leaching, contrary to the teachings and anticipations of the prior art.

EXAMPLE 11

Agglomerative dead roasting, according to the practice of the present invention, can also be applied advantageously to copper sulphide concentrates. Thus, a chalcopyrite concentrate having the following analysis in weight percent:

| Fe | Cu | S |
|---|---|---|
| 30.1 | 27.2 | 30.9 |

and a particle size of 78% −325 Tyler mesh was mixed with water to provide a slurry with a pulp density of about 80% which was then admitted to a fluid bed roaster. The results of roasting at 900°C and 970°C are given in Table 4 below:

Table 4

| Agglomerative Roasting of Chalcopyrite Concentrate | | |
|---|---|---|
| Bed Temperature, °C | 900 | 970 |
| Calcine as Cyclone Dust, wt % | 59.4 | 5.8 |
| Particle Size of Bed Calcine, Tyler Mesh | 12.5% + 35 | 73.1% + 35 |

As can be seen there was a remarkable and most advantageous increase in both bed calcine particle size and recovery by roasting at the higher bed temperature, both of which are indicative of the prevailing agglomerative roasting conditions. The bed temperature was lower than those preferred for the roasting of nickel-copper sulphide concentrate (see Examples 5–7) and pyrrhotite concentrate (see Examples 1–4,8) due to the higher copper to iron ratio in the chalcopyrite concentrate which lowers the fusion temperature. The heat of reaction for roasting chalcopyrite is also lower than that for pyrrhotite, however, and thus additional heat from some source, such as preheated fluidizing gas, might be needed to sustain the temperatures necessary for agglomerative roasting of chalcopyrite concentrates even though they may be lower than those required for pyrrhotite or other concentrates.

We claim:

1. A method for roasting particulate metal sulphides in a fluid bed reactor containing a fluidized bed of hot roasted calcine particles and a freeboard space between the bed and the top of the reactor comprising:

i. feeding a free oxygen-containing gas upwardly through the reactor thereby maintaining the fluidized bed;

ii. feeding an aqueous slurry of metal sulphide particles onto the surface of the fluidized bed thereby supplying both water and sulphide to the bed, iii. both evaporating a majority of the slurry water in the hot bed thereby forming agglomerates of sulphide particles that become dispersed in the bed as evaporation occurs and roasting the sulphide, while controlling the rates of feeding free oxygencontaining gas, water and sulphide to the bed to control temperatures in the bed and in the freeboard space such that fusion occurs during roasting thereby forming roasted calcine agglomerate particles of controlled size and rounded shape, iv. recovering the roasted calcine agglomerate particles from the bed, and v. recovering sulphur dioxide-containing gas from the freeboard space.

2. A method as claimed in claim 1 including passing said sulphur dioxide-containing gas through a cyclone thereby removing entrained calcine agglomerate particles therefrom and producing a substantially clean gas for subsequent sulphur recovery therefrom.

3. Method according to claim 2 in which the metal sulphide is in the form of a mineral concentrate and the mineral is selected from the group comprising pyrrhotite, pentlandite, chalcopyrite and mixtures thereof.

4. Method according to claim 3 in which the metal sulphide is an iron sulphide concentrate consisting predominantly of nickeliferous pyrrhotite.

5. Method according to claim 3 in which the metal sulphide is a nickel-copper sulphide concentrate consisting predominantly of a mixture of pyrrhotite, pentlandite and chalcopyrite.

6. Method according to claim 2 in which the free oxygen-containing gas is selected from the group comprising air, oxygen-enriched air, and oxygen.

7. Method according to claim 2, comprising feeding the aqueous slurry vertically through the freeboard and centrally onto the surface of the bed.

8. Method according to claim 2, comprising feeding the aqueous slurry at a preselected pulp density, feeding auxiliary cooling water onto the surface of the bed, and adjusting the flow rate of the cooling water to compensate for variations in the flow of slurry water resulting from variations in the pulp density of the slurry from the preselected value, thereby maintaining substantially steady bed temperatures.

9. Method according to claim 2 and additionally comprising controlling the feed rates of sulphide and free oxygen-containing gas with respect to one another such that free oxygen is supplied in substantially the stoichiometric quantity required to roast all the metal sulphide to sulphur dioxide and metal oxide thereby producing roasted calcine substantially devoid of sulphur and sulphur dioxide-bearing gas substantially devoid of free oxygen.

10. Method according to claim 9 in which the metal sulphide is nickeliferous pyrrhotite and the metal oxide is hematite.

11. Method according to claim 2 in which the metal sulphide is nickeliferous pyrrhotite, the free oxygen-containing gas is air, and additionally comprising, i. feeding the aqueous slurry at a preselected pulp density vertically through the freeboard and centrally onto the surface of the bed, ii. controlling the feed rate of pyrrhotite relative to that of air such that the free oxygen supplied is substantially the stoichiometric amount required to roast the pyrrhotite to hematite and sulphur dioxide.

iii. feeding auxiliary cooling water onto the surface of the bed at a controlled rate and adjusting the rate to control the bed temperature at a preselected level, thereby producing roasted calcine agglomerate particles of controlled size substantially devoid of sulphur and sulphur dioxide-containing gas substantially devoid of free oxygen.

12. Method according to claim 11, and additionally comprising treating the roasted calcine in a sulphating atmosphere at elevated temperature and subsequently leaching the sulphated calcine in aqueous solution to dissolve nickel therefrom.

13. Method according to claim 11, and additionally comprising treating the roasted calcine in a reducing atmosphere at elevated temperature and subsequently leaching the reduced calcine in ammoniacal solution to dissolve nickel therefrom.

* * * * *